United States Patent [19]

Kremer et al.

[11] 4,241,124

[45] Dec. 23, 1980

[54] INNER SHOE MATERIAL SUCH AS INSOLES AND MIDDLE SOLE MATERIAL IN THE FORM OF BREADTHS OR BLANKS THEREFROM

[75] Inventors: Paul Kremer, Grosskrotzenburg; Bernhard Gora; Ludwig Klinger, both of Hanau, all of Fed. Rep. of Germany

[73] Assignee: Deutsche Gold- und Silber-Scheideanstalt vormals Roesseler, Hanau, Fed. Rep. of Germany

[21] Appl. No.: 917,727

[22] Filed: Jun. 21, 1978

[30] Foreign Application Priority Data

Jun. 25, 1977 [DE] Fed. Rep. of Germany ..... 2728774

[51] Int. Cl.[3] ..... B32B 3/30; B32B 25/16

[52] U.S. Cl. ..... 428/156; 36/43; 36/44; 428/196; 428/245; 428/254; 428/260; 428/261; 428/272; 428/280; 428/290; 428/343; 428/904

[58] Field of Search ..... 428/904, 156, 290, 196, 428/521, 245, 343, 254, 272, 280; 260/887; 36/44, 43; 525/57

[56] References Cited

U.S. PATENT DOCUMENTS

| | | | |
|---|---|---|---|
| 2,567,016 | 9/1951 | Gessler | 525/57 |
| 3,578,481 | 5/1971 | Young | 428/904 |
| 3,856,723 | 12/1974 | Vrisakis et al. | 260/887 |
| 3,961,124 | 6/1976 | Matton | 428/904 |
| 4,092,457 | 5/1978 | Fujita | 428/521 |
| 4,137,110 | 1/1979 | Singh | 36/44 |

FOREIGN PATENT DOCUMENTS

| | | | |
|---|---|---|---|
| 48-5888 | 2/1972 | Japan | 428/904 |
| 46-66383 | 9/1972 | Japan | 428/904 |
| 48-5009 | 2/1973 | Japan | 428/904 |

OTHER PUBLICATIONS

Roberts, Organic Coatings, Properties, Selection and Use Building Science Series 7, 2/1968, pp. 49–50.

*Primary Examiner*—Stanley S. Silverman
*Attorney, Agent, or Firm*—Cushman, Darby & Cushman

[57] ABSTRACT

There is provided inner shoe material in the form of breadths or blanks therefrom consisting of a textile fiber structure which is loaded with 50 to 400 parts by weight based on 100 parts by weight of the textile fibre structure of a mixture of synthetic materials comprising at least one styrene—butadiene copolymer and at least one polyvinyl alcohol obtained by substantial or complete hydrolysis of a polyvinyl ester in an amount of 8 to 102 parts by weight based on 100 parts by weight of the styrene—butadiene copolymer wherein the synthetic material optionally additionally contains fillers, pigments, plasticizers, natural resins, synthetic resins and/or stabilizers against heat, light and/or mechanical influences.

14 Claims, No Drawings

INNER SHOE MATERIAL SUCH AS INSOLES AND MIDDLE SOLE MATERIAL IN THE FORM OF BREADTHS OR BLANKS THEREFROM

BACKGROUND OF THE INVENTION

The invention is directed to a product for use in the interior of shoes such as insole and middle sole materials which are produced in the form of breadths (continuous sheet form) and then are cut into blanks for use in the shoes, for example in the form of soles. The new material has particularly good foot hygenic properties. Based on its synthesis and the structure, particularly of the polymers, which is present in the new material, it has a greatly improved ability to absorb and give off perspiration which is comparable with that of natural leather.

Natural leather is known for use in insoles and midsoles, particularly for high grade footwear. Because of its good mechanical properties and especially because of its good foot hygenic properties this material is preferred. Under foot hygenic properties there is understood particularly the ability to absorb, in a given case in large amounts, to store and also to give up again perspiration without noticeably changing the mechanical properties of the shoe parts.

It is also known to use insoles and midsoles from leather fiber materials. In this connection, there are used materials of natural and/or synthetic fibers which are impregnated, or bound with suitable synthetic materials as for example, natural or synthetic rubber. Besides partially satisfactory mechanical properties leather fiber materials in comparison to natural leathers exhibit especially the disadvantage of insufficient foot hygenic properties, particularly they do not have sufficient ability to absorb perspiration because of their structure and composition. This ability, however, is a required property particularly for insoles and middle soles.

For synthetic insole and midsole materials, there is the need and thus the starting point for the present invention, to find a material which exhibits good foot hygenic properties and particularly a high ability to absorb perspiration, however, at the same time practically retaining constant or at least retaining sufficient mechanical properties such as tear resistance (tensile strength, stitching resistance, dimensional stability and flexural strength (flexing life).

SUMMARY OF THE INVENTION

There has now been found a shoe material such as inner sole material, midsole material or the like in the form of breadths or blanks therefrom comprising or consisting of at least one textile fiber structure, which is loaded with 50 to 400 parts by weight based on 100 parts by weight of the textile fiber structure of a mixture of synthetic materials i.e. synthetic polymer materials, comprising at least one styrene—butadiene copolymer and at least one polyvinyl alcohol obtained by substantial or complete hydrolysis of a polyvinyl ester (e.g. polyvinyl acetate) in an amount of 8 to 100 parts by weight of the styrene—butadiene copolymer wherein the synthetic material (the load) additionally in a given case contains fillers, pigments, plasticizers, natural resins, synthetic resins and/or stabilizers against heat, light and/or mechanical influences. Suitably the new shoe inner material displays on one or both large surfaced sides or outer surfaces as well as in a given case between the loaded textile fiber structures a flexible adhesive material layer based on a thermoplastic synthetic resin. Furthermore, the upwardly or outwardly lying sides (surfaces) of the shoe inner material can be enriched, for example a pattern can be impressed or embossed if desired in the form of rhombs, cups, burls, naps, or the like patterns or can have a relatively thin cover layer, for example of polyvinyl alcohol. These types of covering layers are for example, the so-called sock linings.

Preferably the amount of polyvinyl alcohol of the above mentioned type is 10 to 60 parts by weight based on 100 parts by weight of the styrene-butadiene copolymer.

It has been further found that it is particularly advantageous if the synthetic material mixture, i.e. the loading, additionally contains as filler a titanium dioxide pigment in the amount of 5 to 30 parts by weight based on 100 parts by weight of the styrene-butadiene copolymer. The titanium dioxide pigments which are known per se effect, in case a coloring of the new materials is desired, among other properties a clear improvement in the uniformity of the coloring.

Furthermore, it can be of particular value if the new inner shoe material contains an antimycoticum known in itself (see Carrié in Münchener Medizinische Wochenschrift 1963, page 1417). Examples of such antimycotics include the Myxals®, Antimycoticum Stulln® and Antimykotikum A®. Such antimycotica can, for example, be incorporated additionally into the loading composition or they can be worked into a coating.

As textile fiber structures there are suited woven fabrics, non woven fabrics, fleeces, felts, knitted fabrics and the like textile materials. These textile fibers can be of natural or synthetic origin as, for example, cotton, synthetic fibers based on polyesters such as polyetlhylene terephthalate, as well as polyacrylonitrile, staple rayon and other known raw materials for textile fibers. There can also be employed mixed spun fibers such for example as those from cotton and polyester (e.g. polyethylene terephthalate).

The loading of the textile fiber structure or the agent for the loading according to the invention contains as the polymer basis two groups of different synthetic materials. The first group or class are the copolymers of styrene and butadiene with different high styrene or high butadiene content, which are known by themselves. For this purpose, there are preferably employed those with high styrene content, which alone cannot build films or can only build stiff elastic or partly hard films, with styrene contents from about 85 to 60%. However, there are also useful styrene-butadiene copolymers with lower styrene and higher butadiene content which itself forms highly elastic to weakly elastic films with styrene contents of about 40 to 20%. The use of copolymers having monomer contents lying therebetween are not excluded for the purpose of the present invention.

Preferably, because there are advantages connected therewith, there are used the so-called carboxylated types of these copolymers which have carboxyl groups in the molecules because of their method of manufactures. According to the invention, there can be added simultaneously two or more individually different styrene-butadiene copolymers with advantage for loading the textile fiber structure. The preferred carboxylated types are known commercial polymers.

The second relevant group or class of polymers according to the invention are polyvinyl alcohols which also are known per se and which are produced by solvolysis (alcoholysis, transesterification, hydrolysis) of polyvinyl esters such as polyvinyl propionate and especially polyvinyl acetate and whose degrees of hydrolysis are very high, thus being at 98 to 100% or expressed otherwise are substantially to completely saponified types. The polyvinyl alcohols in the loading composition manifestly cause the good, desired water and perspiration absorption ability and ability to release the same from the new inner shoe materials. The polyvinyl alcohols which can be used have ester numbers (determined as milligrams of KOH per gram) between 4 (±3) and 20 (±5). Their viscosity generally is quite high, between about 66 (±4) and 4 (±1) centipoise (cp) according to DIN 53015 (German Industrial Standard 53015) (1cp=1 mPa s).

Fillers which can be advantageously included in the loading or impregnating composition besides the already mentioned titanium dioxide include calcium carbonate (chalk) and other carbonates, e.g. magnesium carbonate, barium carbonate, strontium carbonate, kaolin, clay, talc, kieselguhr (diatomaceous earth), silica as well as in a given case carbon black and other pigments.

The adhesive layers which optimally are present on one or both sides of the loaded textile fiber structure or on one or both outer sides with several, for example two or three textile fiber structures as well as for joining these together should adaptably be flexible or pliable.

The new shoe inner material has a high water absorption ability and high ability to release the absorbed water which proceeds parallel to or can be approximately equated with the ability to absorb and release perspiration. Thus it can absorb considerably increased amount of water with good dimensional ability. Therefore, in its use it does not undergo or only undergoes insignificant deformation which would be due to water absorption. Stiffness and elasticity remain intact.

Additionally, the new inner material is also suited as a shoe capping material, particularly as a toe capping material. Even in the wet condition it retains especially a high resistance to unstitching in case where nonwovens of endless fibers are used as the textile fiber structure. Furthermore, with the addition of titanium dioxide as the filler it permits nice and uniform dyeing. It is resistant to rotting, in comparison to leather fiber materials has an always uniform structure and color and finally in contrast to leather in regard to its availability is independent e.g. of climate events.

Unless otherwise indicated, all parts and percentages are by weight.

The composition can compose, consist essentially of or consist of the materials set forth.

DESCRIPTION OF THE PREFERRED EMBODIMENTS

EXAMPLES

Examples (B) and comparison (V) are collected in the form of a table. The examples took place as follows:

For the production of the new inner shoe material the polyvinyl alcohols which generally are used in the form of small beads are stirred into cold water and the liquid heated to the boiling temperature with further stirring as a result of which the polyvinyl alcohol dissolves. The polyvinyl alcohol content of the solution was 12 weight percent. After cooling to room temperature there was added to the solution of polyvinyl alcohol the styrene-butadiene copolymer as a dispersion with mild stirring. In the case of the concomitant use of a filler or pigment such as calcium carbonate, clay or titanium dioxide these were stirred into a paste with water in the ratio of 2:1 parts by weight, the paste ground fine and added to the synthetic material containing composition. After homogenization of the entire composition this is ready for use for loading of the textile fiber structure. With the concomitant use of dyes these were introduced into the water before the fine grinding of the filler just described.

The compositions set forth were now applied by means of an impregnating apparatus in the desired weight ratio to the running fabric or fleece. Subsequently, the product was dried at 130° C. to constant weight and then calendered to the stated thickness.

The parts (T) given in the Table are parts by weight. In all the examples the amounts by weight are based on 100 parts by weight of the solid styrene-butadiene copolymers. The total weight given is the final weight of the finished, dry, shoe inner material inclusive of the textile fiber structure.

The following raw materials or textile fiber structure were used and the following abbreviations employed

- SBchS=carboxylated styrene—butadiene copolymer with a styrene content of 81%. The dispersion used had a dry content (i.e. solids content) of 50% at a pH of 8.0–9.0 (Dow Latex 241 of Dow Corning Corp., Midland, Mich.).
- SBhS=styrene—butadiene copolymers having a styrene content of 85%. The dispersion used had a dry content of 51% at a pH of 10.
- SBchB=carboxylated styrene—butadiene copolymer having a butadiene content of 63%. The dispersion used had a dry content of 48% at a pH of 8.0–9.0 (Synthomer Latex 9340 of Synthomer Chemie GmbH, Frankfurt am Main, F.R. of Germany).
- $TiO_2$=Kronos titanium dioxide.
- Kaolin=crystalline kaolinite.
- Calc=finely ground, crystalline, naturally occurring calcium carbonate.
- PES-eV500=Endless polyester fiber non woven fabric having a weight of 500 g/m$^2$.
- PES-eV400=Endless polyester fiber non woven fabric having a weight of 400 g/m$^2$.
- PES-sV325=Staple polyester fiber non woven fabric having a weight of 325 g/m$^2$. (PES-eV 500, PES-eV 400 and PES-sV 325 are all of polyethyleneglycolterephthalate).
- Kalmuk=Cotton fabric in a twill weave napped on both sides and having a weight of 500 g/m$^2$.
- PVA=polyvinyl alcohol: The first number gives the visosity (DIN 53015) of a 4% aqueous solution at 20° C. in cp (1 cp=1 mPas. Pa s=Pascal seconds), the second number is the degree of saponification in mole percent.

Samples B 1.3; B 2.1; B 3.1 and V 3 were colored brown by the addition of Vulkanosal dyestuff. Based on 100 parts by weight of styrene-butadiene copolymer there were added:

1.3 parts by weight brown
1.3 parts by weight yellow and
0.2 parts by weight of black dye.

The water absorption given in percent of total weight was determined as follows:

The sample pieces having a size of 5×10 cm were sealed at the cut edge before the test by means of a thinly liquid nitrocellulose adhesive and then conditioned at least for 48 hours at 65% (±2%) relative air humidity at 20° C. (according to IUP/3) and subsequently weighed on the analytical balance. Then the samples were placed in distilled water at 20° C. After storing for half an hour in the water the sample pieces were again weighed after the water adhering to the surface had been dabbed off with filter paper.

TABLE (EXAMPLE = B; COMPARISON = V)

| | B 1.1 | B 1.2 | B 1.3 | V 1 | B 2.1 | B 2.2 | V 2 |
|---|---|---|---|---|---|---|---|
| Copolymer | 100 T SBchS | 100 T SBchS | 100 T SBchS | 100 T SBchS | 100 T SBchS | 100 T SBchS | 100 T SBchS |
| $TiO_2$ | | | | | 10 T | 10 T | 10 T |
| Calc | | | | | 15 T | 15 T | 15 T |
| Textile fiber structure | PES-eV 500 | PES-eV 500 | PES-eV 500 | PES-eV 500 | PES-eV 500 | PES-eV 500 | PES-eV 500 |
| PVA | 10 T/4-98 | 20 T/28-99 | 30 T/28-99 | | 20 T/28-99 | 20 T/20-98 | |
| Total weight in g/m² | 1 300 | 1 150 | 1 050 | 1 250 | 1 300 | 1 250 | 1 350 |
| Thickness in mm | 2.5-2.6 | 2.3-2.4 | 2.4-2.5 | 2.4-2.5 | 2.4-2.5 | 2.4-2.5 | 2.3-2.4 |
| $H_2O$ - absorption in % | 35 | 50 | 95 | 3 | 60 | 70 | 10 |

| | B 3.1 | B 3.2 | V 3 | B 4.1 | B 4.2 | V 4 |
|---|---|---|---|---|---|---|
| Copolymer | 100 T SBchS | 100 T SBchS | 100 T SBchS | 100 T SBchS | 100 T SBchS | 100 T SBchS |
| $TiO_2$ | 13 T | | | 3 T | 10 T | 3 T |
| Calc | | | | | 15 T | |
| Kaolin | | | | 20 T | | 20 T |
| Textile fiber structure | PES-eV 400 | PES-sV 400 | PES-eV 400 | PES-eV 325 | PES-eV 325 | PES-eV 325 |
| PVA | 30 T/28-99 | 30 T/28-99 | | 30 T/4-98 | 50 T/20-98 | |
| Total Weight in g/m² | 1 050 | 1 050 | 1 200 | 1 150 | 1 000 | 1 150 |
| Thickness in mm | 2.1-2.2 | 2.4-2.5 | 2.3-2.4 | 2.4-2.5 | 2.4-2.5 | 2.2-2.3 |
| $H_2O$ - absorption in % | 80 | 75 | 10 | 40 | 130 | 10 |

| | B 5.1 | B 5.2 | V 5 | B 6.1 | B 6.2 | V 6 |
|---|---|---|---|---|---|---|
| Copolymer | 100 T SBhS | 100 T SBhS | 100 T SBhS | 100 T SBchB | 100 T SBchB | 100 T SBchB |
| Kaolin | 25 T | | 25 T | | | |
| Textile fiber structure | PES-eV 400 | PES-eV 400 | PES-eV 400 | PES-eV 500 | PES-eV 325 | PES-eV 400 |
| PVA | 20 T/66-100 | 50 T/28-99 | | 50 T/28-99 | 20 T/20-98 | |
| Total weight in g/m² | 1,150 | 1,000 | 1,200 | 1,100 | 1,200 | 1,150 |
| Thickness in mm | 2.3-2.4 | 2.3-2.4 | 2.4-2.5 | 2.4-2.5 | 2.4-2.5 | 2.3-2.4 |
| $H_2O$ - absorption in % | 40 | 75 | 15 | 100 | 60 | 30 |

| | B 7 | V 7 |
|---|---|---|
| Copolymer | 50 T SBchS 50 T SBchB | 50 T SBchS 50 T SBchB |
| Textile fiber structure | Kalmuk | Kalmuk |
| PVA | 20 T/28-99 | |
| Total Weight in g/m² | 1,050 | 1,100 |
| Thickness in mm | 1.8-1.9 | 1.8-1.9 |
| $H_2O$ - absorption in % | 55 | 25 |

What is claimed is:

1. An inner sole or midsole inner shoe material in the form of breadths or blanks comprising a textile fiber structure which is impregnated with 50 to 400 parts by weight based on 100 parts by weight of the textile fibre structure of a mixture of synthetic materials comprising at least one styrene-butadiene copolymer and at least one polyvinyl alcohol obtained by substantial or complete hydrolysis of a polyvinyl ester in an amount of 8 to 100 parts by weight based on 100 parts by weight of the styrene-butadiene copolymer, said inner shoe material having high ability to absorb water and high ability to release the absorbed water.

2. An inner shoe material according to claim 1 having on at least one of the two large surface sides a flexible thermoplastic synthetic resin adhesive coating.

3. An inner shoe material according to claim 2 also including said adhesive between the impregnated textile fiber structures.

4. An inner shoe material according to claim 1 having a design printed or embossed on the outer side thereof.

5. An inner shoe material according to claim 1 having a thin coating on the outer side thereof.

6. An inner shoe material according to claim 5 wherein the thin coating is a polyvinyl alcohol coating.

7. An inner shoe material according to claim 1 including titanium dioxide pigment in the loading in an amount of 5 to 30 parts by weight based on 100 parts by weight of the styrene-butadiene copolymer.

8. An inner shoe material according to claim 7 including an antimycoticum.

9. An inner shoes material according to claim 7 wherein the styrene content of the styrene-butadiene copolymer is 60 to 85% by weight.

10. An inner shoe material according to claim 9 wherein the polyvinyl alcohol is a 98 to 100% hydrolyzed polyvinyl ester.

11. An inner shoe material according to claim 1 wherein the styrene content of the styrene-butadiene copolymer is 60 to 85% by weight.

12. An inner shoe material according to claim 1 wherein the polyvinyl alcohol is a 98 to 100% hydrolyzed polyvinyl ester.

13. An inner shoe material according to claim 12 wherein the polyvinyl alcohol has an ester number of 4 (±3) to 20 (±5).

14. An inner show material according to claim 1 including an antimycoticum.

* * * * *